US011167296B2

(12) United States Patent
Fritz et al.

(10) Patent No.: US 11,167,296 B2
(45) Date of Patent: Nov. 9, 2021

(54) APPLICATOR COMPRISING AN INTEGRATED CONTROL CIRCUIT

(71) Applicant: Dürr Systems AG, Bietigheim-Bissingen (DE)

(72) Inventors: Hans-Georg Fritz, Ostfildern (DE); Benjamin Wöhr, Eibensbach (DE); Marcus Kleiner, Besigheim (DE); Mortiz Bubek, Ludwigsburg (DE); Timo Beyl, Besigheim (DE); Frank Herre, Oberriexingen (DE); Steffen Sotzny, Oberstenfeld (DE); Daniel Tandler, Stuttgart (DE); Tobias Berndt, Ditzingen (DE); Andreas Geiger, Suz am Neckar (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 0 days.

(21) Appl. No.: 16/651,025

(22) PCT Filed: Sep. 20, 2018

(86) PCT No.: PCT/EP2018/075472
§ 371 (c)(1),
(2) Date: Mar. 26, 2020

(87) PCT Pub. No.: WO2019/063408
PCT Pub. Date: Apr. 4, 2019

(65) Prior Publication Data

US 2020/0269260 A1 Aug. 27, 2020

(30) Foreign Application Priority Data

Sep. 27, 2017 (DE) ..... 10 2017 122 492.0

(51) Int. Cl.
*B05B 1/30* (2006.01)
*B05B 13/04* (2006.01)
(Continued)

(52) U.S. Cl.
CPC ..... *B05B 1/3053* (2013.01); *B05B 13/0452* (2013.01); *B41J 2/14* (2013.01); *H01F 7/1883* (2013.01); *B41J 2002/041* (2013.01)

(58) Field of Classification Search
CPC ... B05B 1/3053; B05B 13/0452; B05B 12/04; B41J 2/14; B41J 2002/041; H01F 7/1883
See application file for complete search history.

(56) References Cited

U.S. PATENT DOCUMENTS 9,108,424 B2 * 8/2015 Wallsten ..... B41J 2/04
2002/0030707 A1 3/2002 Arnold, Jr.

FOREIGN PATENT DOCUMENTS

DE 10 2012 006 371 A1 7/2012
EP 1821016 A2 8/2007
(Continued)

OTHER PUBLICATIONS

IP.com search (Year: 2021).*
(Continued)

*Primary Examiner* — Lisa Solomon
(74) *Attorney, Agent, or Firm* — Bejin Bieneman PLC

(57) ABSTRACT

The disclosure concerns an applicator, in particular a printhead, for applying a coating agent, in particular a paint, to a component, in particular to a motor vehicle body component or an attachment for a motor vehicle body component, having a plurality of nozzles for applying the coating agent in the form of a coating agent jet, and a plurality of coating agent valves for controlling the release of the coating agent through the individual nozzles, and having a plurality of electrically controllable actuators for controlling the coating
(Continued)

agent valves. The disclosure provides that a control circuit for electrically controlling the actuators is integrated in the applicator.

45 Claims, 7 Drawing Sheets

(51) Int. Cl.

| | |
|---|---|
| ***B41J 2/14*** | (2006.01) |
| ***H01F 7/18*** | (2006.01) |
| ***B41J 2/04*** | (2006.01) |

(56) References Cited

FOREIGN PATENT DOCUMENTS

| | | | |
|---|---|---|---|
| EP | 3213823 | A1 | 9/2017 |
| EP | 3335801 | A1 | 6/2018 |
| WO | 2008131986 | A1 | 11/2008 |
| WO | 2008151714 | A1 | 12/2008 |
| WO | 2010046064 | A1 | 4/2010 |

OTHER PUBLICATIONS

International Search Report and Written Opinion for PCT/EP2018/075472 dated Dec. 14, 2018 (13 pages; with English translation).
Wintrich, Arendt et al; Applikationshandbuch Leistungshalbleiter; First Edition; Published 2015 by ISLE Control Technology and Power Electronics; ISBN 978-3-938843-85-7 (10 pages; with English translation).

* cited by examiner

APPLICATOR COMPRISING AN INTEGRATED CONTROL CIRCUIT

CROSS-REFERENCE TO RELATED APPLICATIONS

This application is a national stage of, and claims priority to, Patent Cooperation Treaty Application No. PCT/EP2018/075472, filed on Sep. 20, 2018, which application claims priority to German Application No. DE 10 2017 122 492.0, filed on Sep. 27, 2017, which applications are hereby incorporated herein by reference in their entireties.

FIELD

The disclosure concerns an applicator (e.g. printhead) for applying a coating agent (e.g. paint) to a component (e.g. motor vehicle body component or add-on part for a motor vehicle body component).

BACKGROUND

State-of-the-art drop-on-demand printheads (e.g. U.S. Pat. No. 9,108,424 B2) are known whose operating principle is based on the use of electromagnetic valves. A magnetic piston (valve needle) is guided in a coil and lifted into the coil by a current supply. This releases a valve opening and, depending on the opening time, the fluid (e.g. the ink) can escape as a drop or as a "jet portion" of various sizes.

With state-of-the-art printheads, both the power electronics and the printhead logic are installed outside the printhead. The power electronics are used to generate the voltages and currents required to operate the electromagnetic valves, while the printhead logic is used to determine the switching times of the individual electromagnetic valves according to a given pattern and in synchronization with the robot controller.

In most cases, printheads are fixed to a fixed holder and the object to be printed (coated) is guided past the printhead. Alternatively, the printhead is mounted on a linear unit by which it is moved linearly back and forth while the object to be printed is guided under the printhead. This results in simple motion sequences. If, however, a printhead is installed on a 6- or 7-axis robot, the motion sequences are much more complex. This also influences the pattern resulting from the desired print image—time sequence—for controlling the valve coils.

If the printhead contains a large number (>5, >10, >20, >50) of electrical coils, each coil must be controlled individually to produce the desired print image. For each coil at least one, possibly also several wires, as well as possibly a common line for mass or voltage supply in the control line is required. The greater the force to be generated by the actuator, the larger and stronger the coil must be designed and the larger the cable cross-section of the individual wires must be, since the current requirement is correspondingly high. The total cable cross-section increases according to the number of wires. The cable bundle must be routed from the control circuit or the power electronics to the printhead.

To control conventional (painting) robots, robot controllers are used which have a specific cycle time (e.g. 8 ms, 4 ms, 2 ms, 1 ms). These are able to send commands to actuators connected to them—either directly or via a bus system—in order to achieve the desired application result. The minimum resolution that can be achieved is defined by the cycle time and the movement speed of the robot.

To apply a graphic, the individual valves must be able to be switched on and off at shorter intervals than the cycle rate of the robot controller allows. For example, with a desired application resolution of 0.1 mm and a maximum robot path speed of 1000 mm/s, a cycle time of maximum 100 μs is required.

Therefore, a separate printhead controller must be used, which is able to control the actuators many times faster than the robot controller. This printhead control is supplied by the robot controller with information for switching the actuators and then processes this independently after it has been triggered by the robot controller.

FIG. 1 shows a schematic representation of a conventional coating installation with a printhead 1 for coating components (e.g. car body components or add-on parts for car body components). The printhead 1 contains a plurality of nozzles for dispensing a narrowly limited jet of coating agent, whereby the dispensing of coating agent from the nozzles is controlled by a plurality of electromagnetic valves 2.

The control of the printhead 1 is done by a printhead control 3, which is connected to the printhead 1 by a multi-wire cable 4. The number of wires in the cable 4 depends on the number of the electromagnetic valves 2 in the printhead 1, which leads to a relatively thick and accordingly inflexible formation of the cable 4 with a high number of electromagnetic valves 2.

On the one hand, the printhead control 3 contains a power electronics 5, which provides the voltages and currents required to control the electromagnetic valves 2.

On the other hand, the printhead control 3 also contains a printhead logic 6 which determines the switching times for the electromagnetic valves 2 and controls the power electronics 5 accordingly.

On the input side, the printhead logic 6 is connected to a graphics module 7 on the one hand and to a robot controller 8 on the other hand. The abbreviations RPC and RCMP shown in the drawings stand for the terms "Robot and Process Control" and "Robot Control Modular Panel".

The graphics module 7 specifies a specific graphic which is to be applied by the printhead 1 to the component (e.g. motor vehicle body component), whereby the graphic specified by the graphics module 7 determines the switching times for the electromagnetic valves 2. The printhead logic 6 then determines the switching points depending on the graphic specified by the graphics module 7.

The robot controller 8 controls the multi-axis coating robot, which guides the printhead 1 over the component to be coated (e.g. motor vehicle body component). The corresponding robot control data is transmitted from the robot control 8 to the printhead logic 6. For example, these robot control data may include the position and orientation of the printhead 1 or at least allow the position and orientation of printhead 1 to be derived from the robot control data. The printhead logic then determines the switching times for the electromagnetic valves 2 depending on the graphic specified by the graphics module 7, taking into account the robot control data supplied by the robot controller 8, which allows synchronization with the robot movement.

With regard to the general technical background of the disclosure, reference should also be made to US 2002/0030707 A1, DE 10 2012 006 371 A1, EP 1 821 016 A2, WO 2010/046064 A1 and "Applikationshandbuch Leistungshalbleiter", ISBN 978-3-938843-85-7.

DETAILED DESCRIPTION

Figure 1:
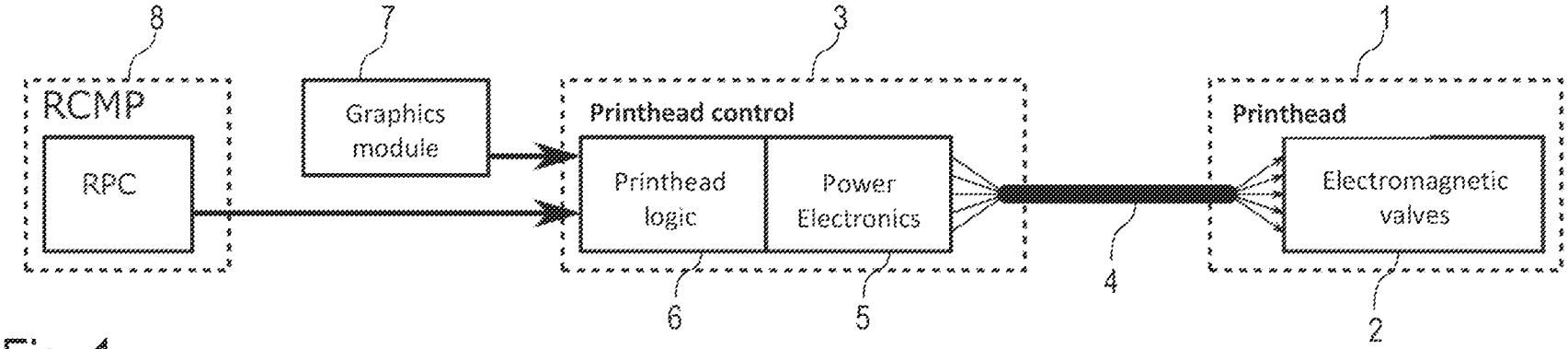
Fig. 1 Prior art
FIG. 1 a schematic representation of a conventional painting installation with a printhead.

The disclosure is therefore based on the task of creating a correspondingly improved applicator (e.g. printhead).

The applicator (e.g. printhead) according to the disclosure is generally suitable for the application of a coating agent. The disclosure is therefore not limited to a specific coating agent with regard to the type of coating agent to be applied. Preferably, however, the printhead is designed for the application of a paint. Alternatively, it is possible that the coating agent is an adhesive or a sealing material, e.g. for seam sealing in car bodies. The applicator according to the disclosure can therefore also be designed as an adhesive applicator or as a sealing material applicator.

It should also be mentioned that the printhead according to the disclosure is generally suitable for applying the coating agent (e.g. paint) to a specific component. With regard to the type of component to be coated, the disclosure is also not limited. Preferably, however, the printhead according to the disclosure is designed to apply a coating (e.g. paint) to a motor vehicle body component or an add-on part of a motor vehicle body component.

In accordance with the state of the art, the applicator according to the disclosure initially has several nozzles for applying the coating agent in the form of a coating agent jet. Each of the nozzles therefore emits an individually controllable jet of coating agent.

It should be mentioned here that the printhead according to the disclosure does not emit a spray cone of the coating agent from the nozzles, but rather spatially limited jets with only a small jet expansion. The printhead according to the disclosure differs from atomizers (e.g. rotary atomizers, air atomizers, etc.), which do not emit a spatially limited jet of the coating medium, but a spray cone of the coating medium.

The individual coating agent jets can each consist of spatially separated coating agent droplets, so that the coating agent jet can also be described as a droplet jet. Alternatively, there is also the possibility that the coating agent jets are contiguous in the longitudinal direction of the jet.

In addition, in accordance with the state of the art, the applicator according to the disclosure has several coating agent valves to control the release of coating agent through the individual nozzles.

These coating agent valves can conventionally be controlled by several electrically controllable actuators (e.g. magnet actuators), so that the electrical control of the actuators controls the release of coating agent through the nozzles. However, the disclosure is not limited to magnet actuators with regard to the technical-physical principle of action of the actuators, but can also be realized with other actuator types, for example with piezo electric actuators, to name just one example.

The applicator according to the disclosure is now distinguished from the state of the art by the fact that a control circuit for the electrical control of the actuators is integrated in the printhead.

The integration of the control circuit into the applicator (e.g. printhead) enables a shortening of the cable lengths between the control circuit and the actuators, whereby disturbing inductivities and capacitances are reduced.

In addition, the integration of the control circuit into the applicator (e.g. printhead) also leads to a reduction in EMC emissions and reduced susceptibility to external EMC emissions due to the shortening of the cable lengths.

Furthermore, the shortened cables between the control circuit and the actuators are also less susceptible to interruptions.

Furthermore, the shortened lines between the control circuit and the actuators allow a higher cycle rate of the coating valves or shorter switching times.

By integrating the control circuit into the printhead, not only can the number of wires required in the line be significantly reduced, but also their cross section. If the control circuit is installed in the control cabinet in the conventional way, distances in the range of 10 m-50 m must often be bridged up to the printhead. The currents required for the valve coils in the ampere range require a certain cross-section in order to minimize line loss. This cross-section must be provided for each coil. If, on the other hand, the power electronics are integrated into the printhead, the currents can be minimized by selecting a higher supply voltage for the power electronics (e.g. 48V) than the nominal voltage of the coil (e.g. 12V). On the other hand, the current can be reduced even further by controlling the individual coils one after the other in a slightly offset manner rather than simultaneously. This can be achieved with the high clock rate of the integrated control logic. For this it is necessary that the clock rate is even higher than required by the application resolution.

For example, the integrated control circuit can contain power electronics for controlling the actuators. This means that the power electronics provide the voltages and currents required to operate the actuators.

The integration of the power electronics into the applicator enables short lines between the power electronics and the actuators, whereby the line length, for example, can be a maximum of 300 mm, a maximum of 200 mm, a maximum of 100 mm or a maximum of 50 mm or even a maximum of 10 mm. In borderline cases, the power electronics can also be mounted directly on the actuators.

It should also be mentioned that the power electronics drive the actuators with an electrical voltage that is preferably in the 6V-96V range, especially in the 12V-48V range.

The actuators are controlled by the power electronics in such a way that an electrical current flows through the individual actuators, preferably in the range 0.01 A-10 A, especially in the range 0.25 A-5 A or 0.05 A-1 A.

The power electronics preferably control the actuators with a pulse width modulation (PWM) with a variable duty cycle. However, the disclosure is not limited to pulse width modulation with regard to the type of modulation used, but can also be implemented with other types of modulation.

In addition, the integrated control circuit can also include a printhead logic as described above. The printhead logic is connected to the power electronics on the output side and determines the switching times for the individual coating agent valves of the printhead. On the input side, the printhead logic is connected to a robot controller and/or a graphics module.

The graphics module defines switching patterns for the actuators which communicates with actor programs and the path programs for robot movement according to a predefined graphic that is to be applied to the component and the geometric shape of target component. These switching patterns are transferred from the graphics module to the printhead logic. This transfer may be direct or via the robot controller, which also has to receive the path programs.

Figure 11:
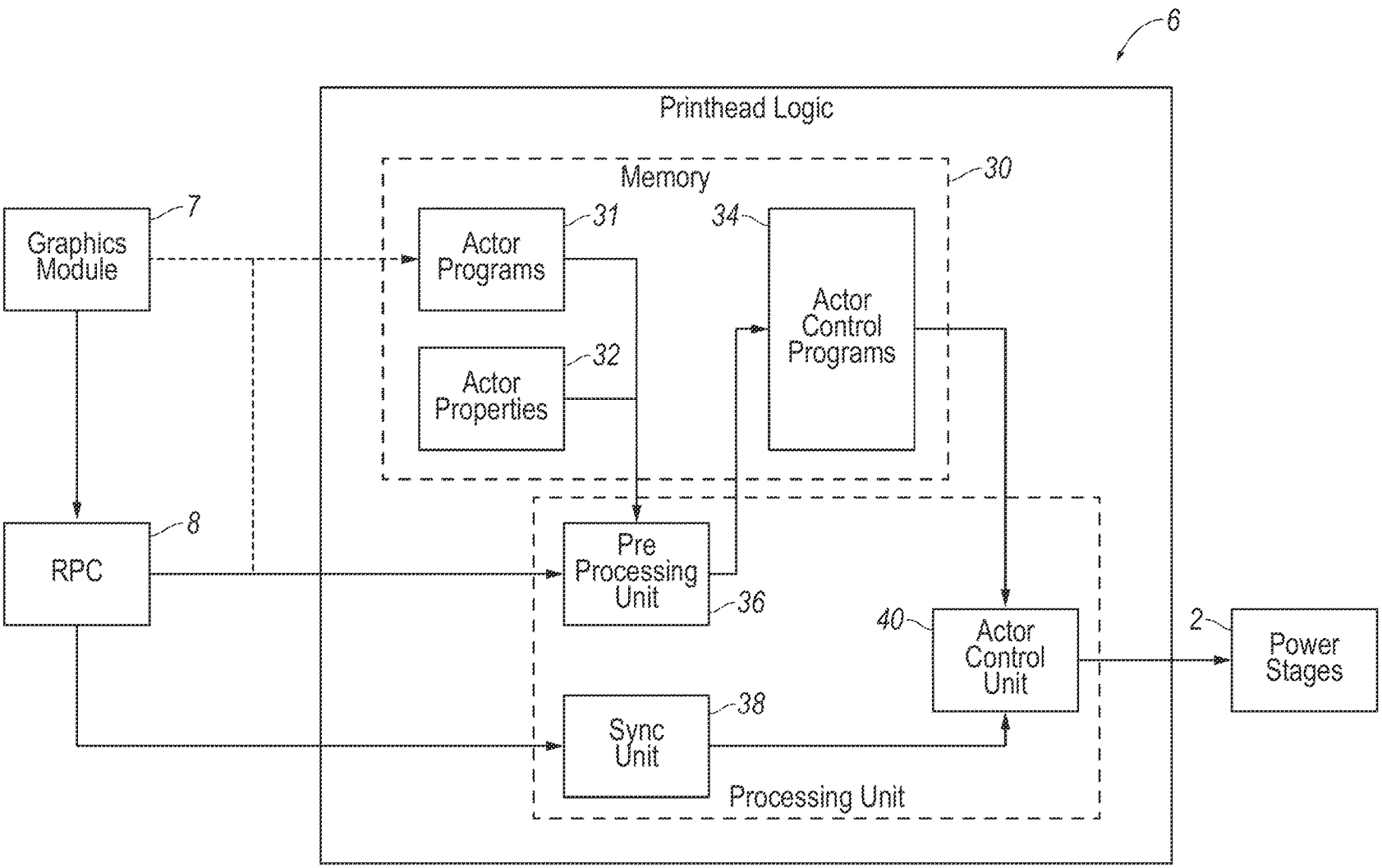
FIG. 11 is a schematic drawing of an exemplary print head logic.

An example embodiment of such a printhead logic is shown in FIG. 11. It contains processing unit and a memory to store the actor programs from the graphics module as well as actor parameters. The processing unit is subdivided into a preprocessing unit, a synchronisation unit and an actor control unit.

The robot controller controls the coating robot, which moves the printhead over the component under program control, whereby the robot controller reports the corresponding robot control data to the printhead logic so that the printhead logic can determine the switching points for the individual coating agent valves depending on the robot control data. For example, the robot control data can reflect the position and orientation of the printhead. Alternatively, it is also possible for the printhead logic to derive the printhead position and orientation from the robot control data only. The robot control data is received by the preprocessing and the synchronization unit of the printhead logic controller.

The printhead logic then determines the switching points depending on the robot control data and/or depending on the switching patterns of the graphics module and controls the power electronics accordingly.

The preprocessing unit of the printhead logic combines the information from previously stored actor programs, which were created by the graphics module and actor parameters which define the opening and closing processes for each actor. These may be different for each piece of printhead and are defined by a program, which is generated in a higher-level unit. The output of the preprocessing unit is at least one actor control program, which controls the opening and closing processes of the nozzles via the control of the actuators, which are connected to actuator needles. The state of each valve (open or closed) is stored in this program for each robot position with reference to the surface to be painted. The synchronization unit triggers the actor control unit according to the robot position and/or movement.

It is possible that the printhead continuously ejects coating material in the form of jets or that it ejects coating material in the form of drops. In the latter case, the controller opens and closes the nozzles at high frequency (e.g. 10 Hz-2000 Hz, 100 Hz-10000 Hz) while the printhead is guided by the robot over the area to be coated.

The printhead logic therefore preferably has at least one of the following components or assemblies:

- A communication interface for communication with the robot controller,
- a first logic unit for the logical processing of the switching patterns supplied by the graphics module,
- a synchronisation device for synchronising the switching patterns supplied by the graphics module with the robot controller, and/or
- a second logic unit for compensating tolerances in the control chain to the actuators in order to achieve exact synchronization of the individual channels for the various actuators.

The printhead control switches the valves substantially exactly corresponding to the position of the robot. For this purpose, the control circuit is synchronized with the cycle of the robot controller and triggered by it when the specified valve program is to be executed.

Since the individual valves may have different characteristics (e.g. due to manufacturing tolerances), the control circuit contains mechanisms to compensate for these by individually controlling each valve. The integration of the control circuit into the applicator (e.g. printhead) results in a unit that can be completely tested and parameterized. This makes it possible for the user to easily change the printhead from one robot to another.

In one form of the disclosure, the actuators are electromagnetic actuators, each with a coil. Depending on the current applied to the coil, an armature is then moved in the coil, whereby the armature acts directly or indirectly on a valve needle. To open a coating agent valve, the power electronics then control the coil of the actuator in question with a relatively high starting current. After opening and to keep the coating valve open, the power electronics only have to drive the actuator with a lower holding current, which is lower than the starting current.

If the actuators are designed as electromagnetic actuators with one coil each, the coil is preferably permanently connected to ground or to a supply voltage with a first coil connection irrespective of the switching state, while the second coil connection is connected to ground or to a supply voltage via a controllable switching element. The controllable switching element for switching the coil can be arranged on either the plus side ("high side") or the minus side ("low side"). In addition, a free-wheeling diode can be connected in parallel to the coil.

In another example of the disclosure, on the other hand, both coil connections are connected to supply voltage or ground via a controllable switching element. This disclosure variant with two controllable switching elements for switching the coil is advantageous for two reasons. Firstly, the energy stored in the magnetic field of the coil is not consumed in the coil, but flows back into the supply. On the other hand, this rearrangement of the energy by two switching elements is much faster than the consumption in the coil.

However, these two advantages are offset by the disadvantage of a higher installation effort, since two wires are required for each valve, while the switching of the coil with only a single switching element needs correspondingly fewer wires. This disadvantage, however, is secondary to the integration of the power electronics into the printhead in accordance with the disclosure, since only short lines are required between the power electronics and the actuators.

With this variant of the disclosure with two controllable switching elements for switching the coil, either two free-wheeling diodes or two further controllable switching elements can be provided.

A further feature of simple power output stages is the simple switching of the pulse width modulation (PWM) between two different duty cycles in order to control the coils with a high voltage for opening and with a lower voltage for holding. The current through the coil then results from the resulting voltages, the DC resistance (RDC) of the coil and the line resistances in the supply line. Since the DC resistance (RDC) is typically in the range of a few ohms, it becomes clear that the influence of the line resistances can no longer be neglected. It has a direct influence on the current flowing in the coil and thus on the force that the actuator can apply. The more variable the line resistance is (e.g. due to different cable lengths and/or cross-sections), the more annoying this influence becomes and can be significantly minimized by integration into the applicator. The closer the power electronics are to the actuator, the smaller are the influences of the connection between the two components. Due to the positioning of the power electronics in the printhead, the electrical leads to the actuators are short (≤300 mm, ≤250 mm, ≤200 mm or even ≤150 mm). In addition, this connection no longer has to follow the movements of the robot, but can be fixed.

In addition, there are variances resulting from temperature influences (especially coil resistance). In simple control systems, these are compensated together with the line losses in such a way that the coils are operated with a higher voltage than is actually necessary in order to have sufficient functional reserve. As a result, more current than is actually necessary usually flows in the coils, which in turn leads to higher heat development and makes the system less efficient overall. It is therefore essentially better to regulate the current in the coils instead of operating the coil with different voltages. The stability of the control system also benefits from integration into the printhead, as external influences are reduced to a minimum.

It should also be mentioned that the control circuit can be integrated in the applicator housing or in a connecting flange of the applicator.

Figure 10:
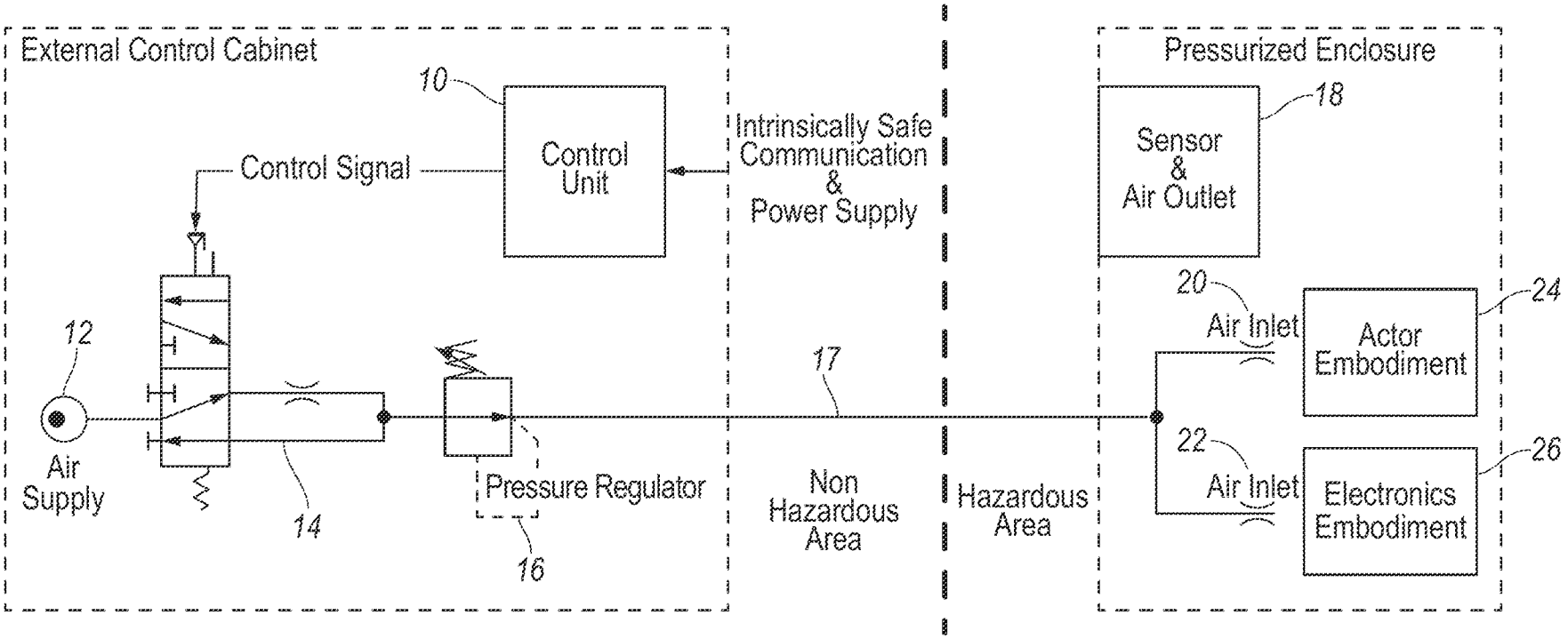
FIG. 10 is a schematic drawing of an exemplary explosion protection for a print head.

In the preferred example of the disclosure, the applicator is explosion-protected according to DIN EN 60079-0 or IEC 60079-0. There are several possible types of protection like encapsulation, flameproof enclosures, powder filling, liquid immersion, intrinsic safety or increased safety, just to mention some of them. They may be used solely or in combination but in particular we describe a pressurized enclosure according to DIN EN 60079-2. This can be achieved, for example, by flushing the housing of the applicator with compressed gas as illustrated in FIG. 10. In order to make the applicator (e.g. printhead) explosion-proof in accordance with the applicable regulations, the entire housing can be purged with an inert gas (e.g. compressed air) so that a low internal pressure (<1 bar) is built up. A possible embodiment is shown in FIG. 10, were a certain gas stream controlled by a nozzle is flowing into the enclosure. A sensor connected with a control unit con-stantly measures the internal pressure. The limit values (minimum pressure and maximum pressure) of the internal pressure are part of the safety concept and are stored in this higher-level control system. The gas introduced into the housing escapes via a bore (a throttle, a valve, a non-return valve) in the housing or in a component adjacent to the housing into the vicinity of the printhead or into other pressureless areas, e.g. via the hand axis into the robot arm. The control unit may optionally control a valve to release a higher gas volume flowing into the en-closure e.g. before the electronics may be powered up. In a special version, the gas is intro-duced into the housing in such a way that it cools the actuators and/or the electronic components. The electrical components (e.g. circuit boards, components) can also be coated with a self-crosslinking polymer, completely or partly encapsulated with to achieve the explosion protection goal.

The wiring between the robot controller and the printhead controller can be reduced to a minimum. The cable can include a power supply for the actuators, especially with a voltage of 48 VDC at a power of 0.1 kW, 0.5 kW or more than 1 kW. In addition, the cable can have a control voltage supply for the printhead logic and/or power electronics, especially with a voltage of 24 VDC. The cable can also be equipped with potential equalization and/or a communication connection (e.g. Ethernet connection) for connection to the robot controller.

The disclosure also allows the cable to be a hybrid cable in which all the wires of the cable are under a common protective sheath and/or several functions share a common wire of the cable, in particular a common ground line.

Finally, it should be mentioned that the connections to the applicator for the robot controller, the graphics module and/or the printhead logic should be detachable, in particular pluggable. Here, the connections to the applicator can, for example, be in a housing, in a connecting flange, on the outside of the housing or on the outside of the connecting flange of the applicator.

Figure 2:
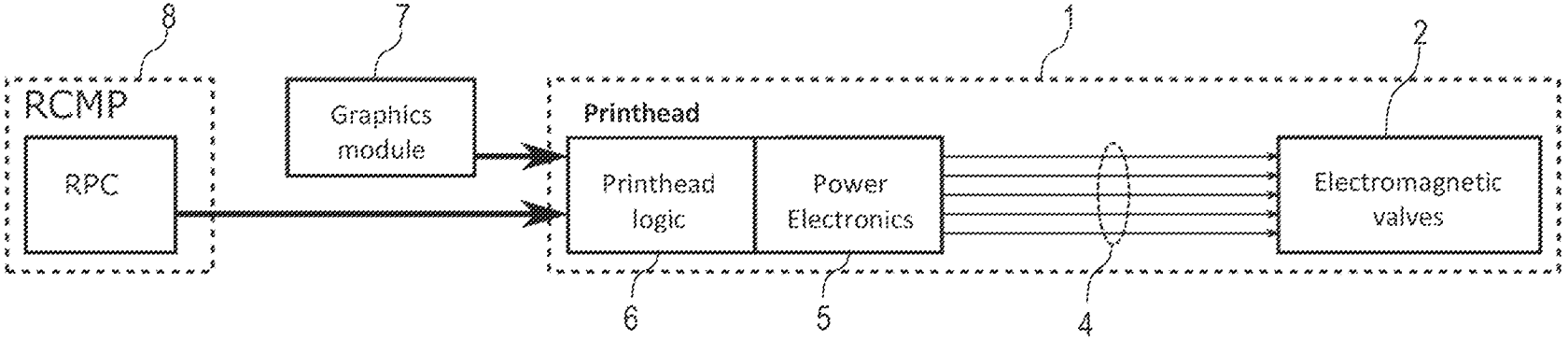
FIG. 2 shows a schematic representation of an disclosure-based painting installation, in which a printhead logic and power electronics are integrated into the printhead.

FIG. 2 shows a schematic illustration of a painting installation according to the disclosure that can be used, for example, to paint vehicle body components. This embodiment according to the disclosure partly corresponds to the representation described above and shown in FIG. 1, so that reference is made to the above description in order to avoid repetitions, whereby the same reference signs are used for corresponding details.

A feature of this embodiment is that the printhead logic 6 and the power electronics 5 are integrated into the printhead 1.

On the one hand, this has the advantage that the lines 4 between the power electronics 5 and the electromagnetic valves 2 are less susceptible to interruptions.

On the other hand, the lines between the power electronics 5 and the electromagnetic valves 2 are also less susceptible to interfering EMC emissions from outside.

Another advantage is that the lines between the power electronics 5 and the electromagnetic valves 2 are shorter, so that less power loss occurs in the lines and time influences are also less strong.

In general, by shortening the lines, less additional ohmic resistance, inductances and capacitances are created.

In addition, the lines between the power electronics 5 and the electromagnetic valves 2 are not subject to any mechanical deformation due to the integration of the power electronics in the printhead 1, as is the case with state-of-the-art technology.

Figure 3:
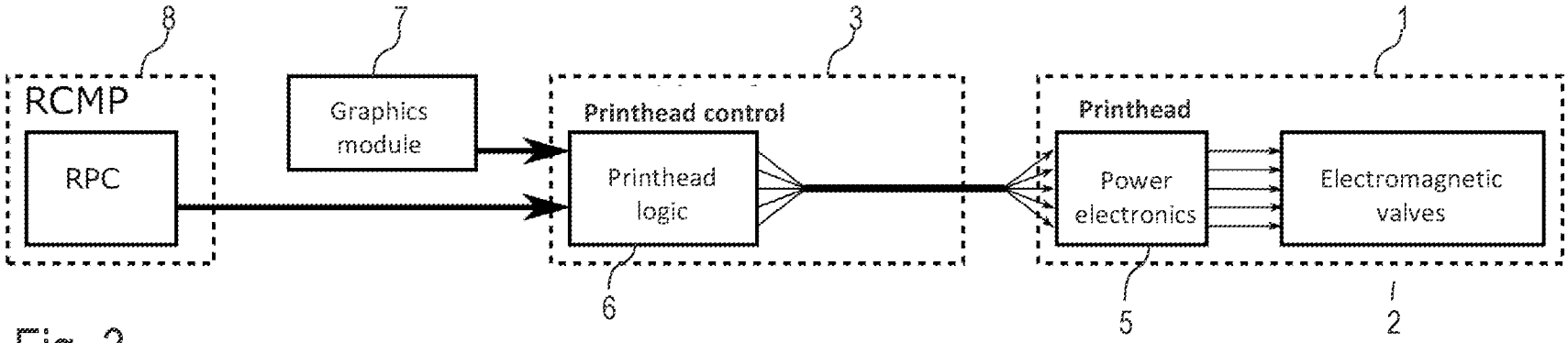
FIG. 3 is a modification of FIG. 2, where only the power electronics are integrated into the printhead.

FIG. 3 shows a variation of the embodiment shown in FIG. 2, so that to avoid repetitions, reference is made to the above description, using the same reference marks for the corresponding details.

A feature of this embodiment is that only the power electronics 5 are integrated in the printhead 1, whereas the printhead logic 6 is arranged outside the printhead 1 in a printhead control 3.

Figure 4:
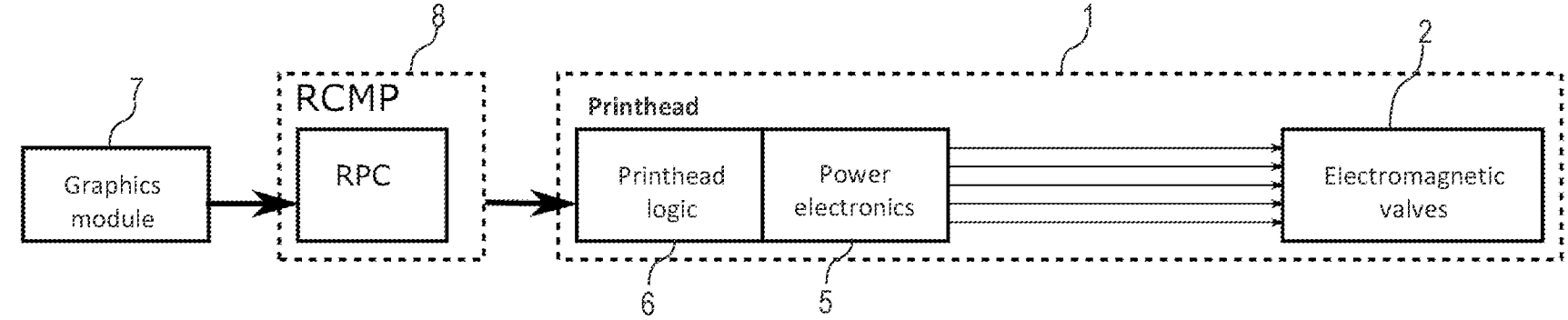
FIG. 4 is a modification of FIG. 2, whereby a graphics module of the robot control is pre-designed, FIG. 5 a schematic diagram illustrating the control of a coil of an electromagnetic valve by a single switching element, FIG. 6 a modification of FIG. 5 with two switching elements for controlling the coil, FIG. 7 a modification of FIG. 6 with two additional switching elements instead of the free-wheeling diodes in FIG. 6.

The example shown in FIG. 4 again largely corresponds to the examples described above, so that reference is made to the above description to avoid repetition, using the same reference marks for appropriate details.

A feature of this example is that the printhead logic 6 is not directly connected to the graphics module 7, as in FIGS. 1-3. Rather, the robot controller 8 is arranged between the printhead logic 6 and the graphics module 7. The printhead logic 6 is therefore only indirectly connected to the graphics module 7.

Figure 5:
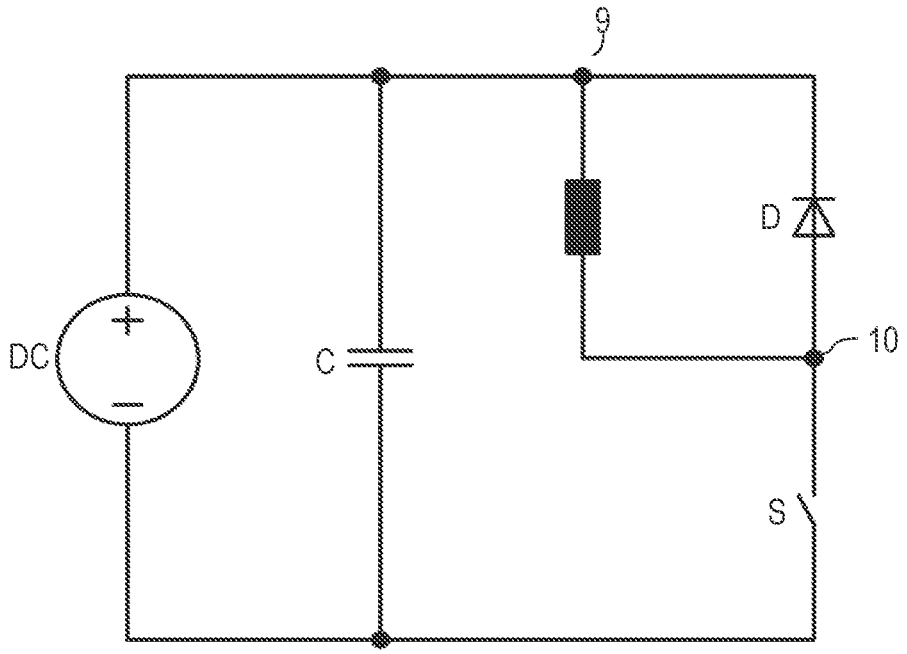

FIG. 5 shows a simplified circuit diagram for controlling a coil L in the electromagnetic valves 2. A first coil connection 9 of the coil L is directly connected to a supply voltage DC. A second coil connection 10, on the other hand, is connected to ground via a controllable switching element S. The coil connection 9 is directly connected to a supply voltage DC.

A freewheeling diode D is connected in parallel to the coil L. The voltage of the coil is controlled by the voltage of the ground.

In addition, a capacitor C is connected in parallel to the supply voltage DC.

The design of the power output stage described above is comparatively simple, but this design may extend the closing times of the electromagnetic valves 2. In the closed state of the controllable switching element S, energy is fed in and stored in the magnetic field of the coil L. This energy is then used to control the valve. If the controllable switching element S is now opened, the current continues to flow via the free-wheeling diode D due to the stored energy until the magnetic field is essentially completely eliminated.

Figure 6:
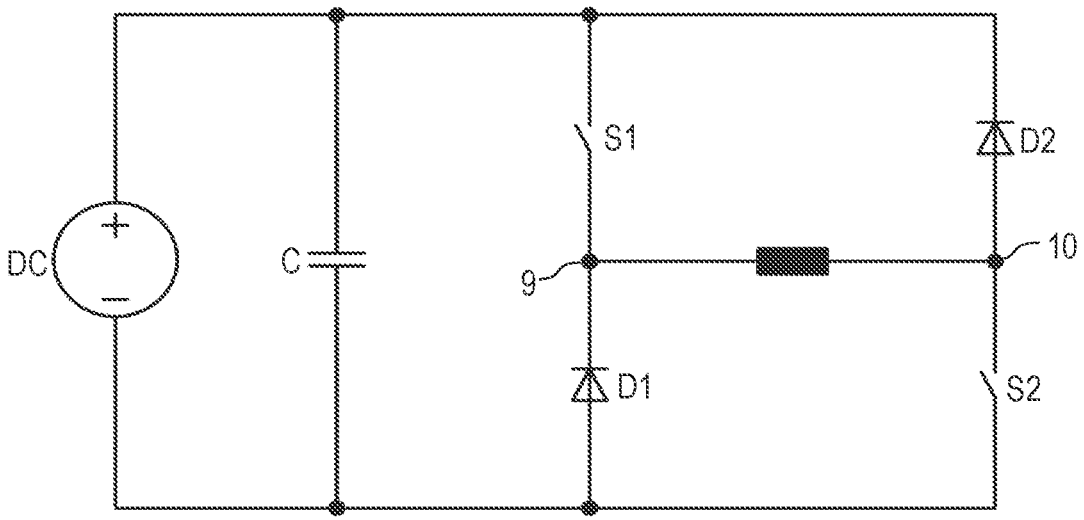

FIG. 6 therefore shows an alternative possible design of a power output stage, which in turn partly corresponds to the simple design described above, so that reference is made to the above description to avoid repetitions, whereby the same reference signs are used for the corresponding details.

A feature of this design is that the first coil connection 9 is connected to the supply voltage DC via a first controllable switching element S1, while the second coil connection C is connected to ground via a second controllable switching element S2. Two wires are used for each of the valves 2 to control the two switching elements S1, S2.

In addition, the first coil terminal 9 is connected to ground via a first free-wheeling diode D1, while the second coil terminal C is connected to the supply voltage DC via a second free-wheeling diode D2.

This design of the power output stage has two benefits. Firstly, the energy stored in the magnetic field of the coil L is not consumed in the coil L, but flows back into the supply or the storage capacitor C. The second benefit is that the energy is not consumed in the coil L, but flows back into the supply or the storage capacitor C. On the other hand, this rearrangement of the energy from the coil L is much faster than the consumption.

Figure 7:
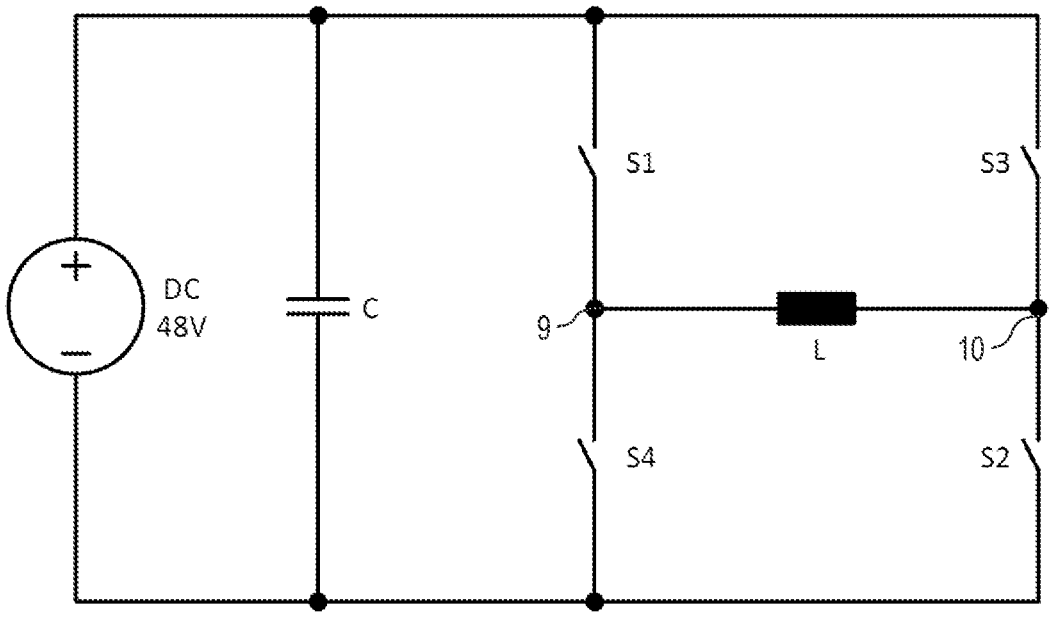

FIG. 7 shows a modification of the embodiment according to FIG. 6, so that to avoid repetitions, reference is made to the above description, using the same reference signs for the corresponding details.

A feature of this embodiment is that the two free-wheeling diodes D1, D2 have been replaced by two controllable switching elements S3, S4.

Figure 8:
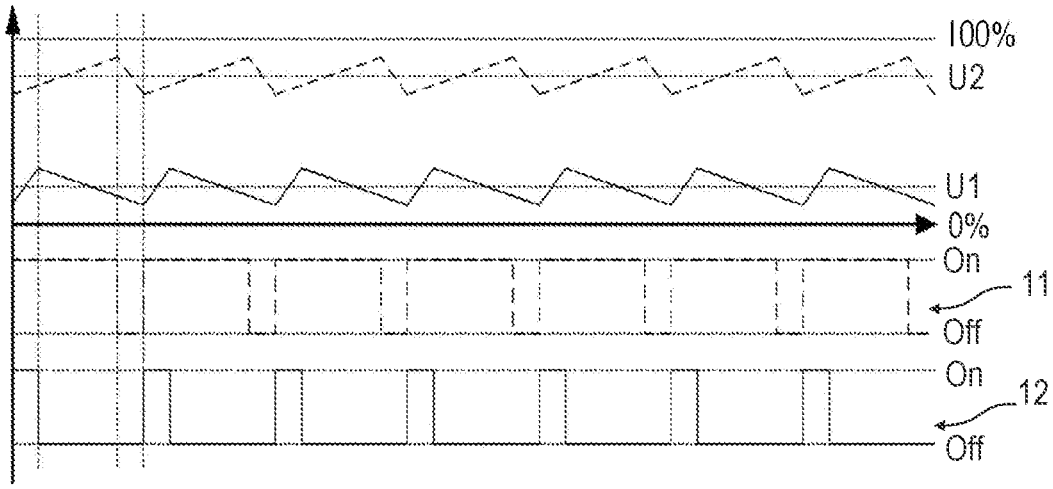
FIG. 8 shows a diagram illustrating the pulse width modulated voltages for two different switching patterns.

FIG. 8 shows a diagram illustrating two different voltages U1, U2 in pulse width modulation by two different switching patterns 11, 12. Switch pattern 11 generates the relatively high voltage U2, while the switching pattern 12 generates the lower voltage U1.

Figure 9:
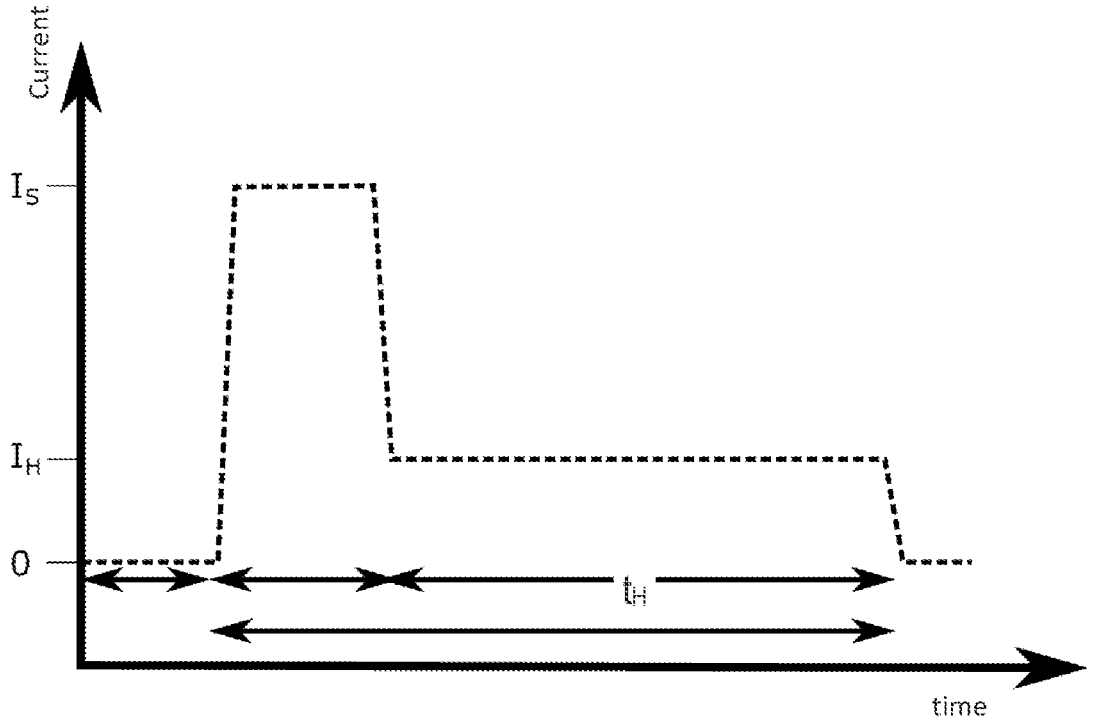
FIG. 9 shows the current curve when switching a coil.

Finally, FIG. 9 shows the current curve when actuating one of the electromagnetic valves 2. After a start offset $t_v$, the current I first rises to a start current Is and is then held at this value for a start duration $t_S$. Then the current drops to a smaller holding current $I_H$ and is held at this lower value for a certain holding time $t_H$.

With reference to FIG. 10 there is shown a schematic of an exemplary over pressure explosion protection for print head 1. As illustrated a control unit 10 resides external to the hazardous area (paint booth) and is operative to control an overpressure condition internal to printhead 1. Control unit 10 sends a control signal to an air valve which is operable to deliver air from an air supply 12 to a pressure regulator 16. Air is in turn delivered through air line 17 routed through robot (not shown) to air inlets 20, 22 within print head 1. As shown in FIG. 10 printhead 1 may include actor embodiment 24 and electronics embodiment 26. As noted, Actor embodiment 24 includes the actuators and servomotors that act to deliver paint and the electronics embodiment 26 includes the miniature electronics that control the electronics. In operation air line 17 delivers air to printhead 1 to create an overpressure condition. Air pressure internal to print head 1 is measured by sensor/air outlet 18. The air pressure measured at sensor/air outlet 18 is communicated to control unit 10. This communication may be with a wire or wireless. Control unit 10 in turn operates valve 14 to ensure that the proper over pressure condition is maintained.

With reference to FIG. 11 there is shown a schematic of the printhead logic 6 contained in printhead 1. Print head logic 6 includes a memory 30 having contained therein actor programs 31, actor properties 32 and actor control programs 34. Printhead logic 6 also includes a preprocessing unit 36 which receives instructions from graphics module 7 and Robot Control 8. Preprocessing unit 36, together with information from actor programs 31 and actor properties 32 feed instructions to actor control unit 40 through actor control programs 34. Actor Control unit 40 receives information from sync unit 38 so that the movements of the robot can be coordinated to deliver instructions to power stages 2 (power stages 2 are the electromagnetic valves that control paint flow), so that the graphic can be properly applied to, for example, an automotive body.

The disclosure is not limited to the preferred embodiments described above.

The invention claimed is:

1. A Coating robot with an applicator wherein the applicator comprises:

a) several nozzles for the application of the coating agent in the form of a coating agent jet, b) a plurality of coating agent valves for controlling the release of the coating agent through the individual nozzles, and c) a plurality of electrically controllable actuators for controlling the coating agent valves, d) wherein a control circuit for electrically driving the actuators is integrated in the applicator.

2. A coating robot according to claim 1, wherein the integrated control circuit contains power electronics for driving the actuators.

3. A coating robot according to claim 2, wherein the power electronics are connected to the actuators via short lines with a line length of at most 300 mm.

4. A coating robot according to claim 2, wherein the power electronics drive the actuators with an electrical voltage which is in the range from 6V-96V.

5. A coating robot according to claim 2, wherein the power electronics actuate the individual actuators in such a way that an electric current flows through the individual actuators which is in the range from 0.01 A-10 A.

6. A coating robot according to claim 2, wherein the power electronics drive the actuators with a pulse width modulation with a variable duty cycle or a frequency modulation or another modulation.

7. A coating robot according to claim 2, wherein a) the integrated control circuit also comprises a printhead logic, b) the printhead logic is connected on the output side to the power electronics, c) the printhead logic is connected on the input side to at least one of a robot controller and a graphics module, d) the robot controller controls a coating robot which moves the applicator in a program-controlled manner over the component, the robot controller reporting robot control data to the printhead logic, e) the graphics module specifies switching patterns for the actuators in accordance with a predefined graphic and reports them to the printhead logic, and f) the printhead logic controls the power electronics as a function of the robot control data and as a function of the switching patterns.

8. A coating robot according to claim 7, wherein the printhead logic comprises at least one of the following:

a) a communication interface for communication with the robot controller, b) a first logic unit for logically processing the switching patterns supplied by the graphics module, c) a synchronisation device for synchronising the switching patterns supplied by the graphics module with the robot controller, d) a second logic unit for compensating tolerances in the control chain to the actuators in order to achieve exact synchronization of the individual channels for the various actuators.

9. A coating robot according to claim 2, wherein a) the actuators are electromagnetic actuators which each have a coil, b) the power electronics drive the coil of one of the actuators for opening the associated coating agent valve with a starting current, and c) the power electronics drive the coil of one of the actuators with a holding current in order to keep the associated coating agent valve, which has already been opened previously, open, the holding current being smaller than the starting current.

10. A coating robot according to claim 1, wherein a) the actuators are electromagnetic actuators which each have a coil, b) with a first coil connection, the coil is permanently connected to ground or to a supply voltage irrespective of the switching state, c) with a second coil connection, the coil is connected via a controllable switching element to ground or to a supply voltage.

11. A coating robot according to claim 10, wherein a free-wheeling diode is connected in parallel with the coil.

12. A coating robot according to claim 1, wherein a) the actuators are electromagnetic actuators which each have a coil, b) with a first coil connection, the coil is connected via a first controllable switching element with a supply voltage, and c) with a second coil connection, the coil is connected to ground via a second controllable switching element.

13. A coating robot according to claim 12, wherein a) with the second coil connection, the coil is connected to the supply voltage via a second free-wheeling diode or via a third controllable switching element, and b) with the first coil connection, the coil is connected to ground via a first freewheeling diode or a fourth controllable switching element.

14. A coating robot according to claim 1, wherein the control circuit is integrated in the housing of the applicator.

15. A coating robot according to claim 1, wherein the control circuit is integrated in the connecting flange of the applicator.

16. A coating robot in accordance with claim 1, wherein the applicator is explosion-proof.

17. An applicator for applying a coating agent to a component, comprising:

a) several nozzles for the application of the coating agent in the form of a coating agent jet, b) a plurality of coating agent valves for controlling the release of the coating agent through the individual nozzles, and c) a plurality of electrically controllable actuators for controlling the coating agent valves, d) wherein a control circuit for electrically driving the actuators is integrated in the applicator, the integrated control circuit contains power electronics for driving the actuators;

e) the actuators are electromagnetic actuators which each have a coil, f) the power electronics drive the coil of one of the actuators for opening the associated coating agent valve with a starting current, and g) the power electronics drive the coil of one of the actuators with a holding current in order to keep the associated coating agent valve, which has already been opened previously, open, the holding current being smaller than the starting current.

18. An applicator according to claim 17, wherein the power electronics are connected to the actuators via short lines with a line length of at most 300 mm.

19. An applicator according to claim 17, wherein the power electronics drive the actuators with an electrical voltage which is in the range from 6V-96V.

20. An applicator according to claim 17, wherein the power electronics actuate the individual actuators in such a way that an electric current flows through the individual actuators which is in the range from 0.01 A-10 A.

21. An applicator according to claim 17, wherein the power electronics drive the actuators with a pulse width modulation with a variable duty cycle or a frequency modulation or another modulation.

22. An applicator according to claim 17, wherein a) the integrated control circuit also comprises a printhead logic, b) the printhead logic is connected on the output side to the power electronics, c) the printhead logic is connected on the input side to at least one of a robot controller and a graphics module, d) the robot controller controls a coating robot which moves the applicator in a program-controlled manner over the component, the robot controller reporting robot control data to the printhead logic, e) the graphics module specifies switching patterns for the actuators in accordance with a predefined graphic and reports them to the printhead logic, and f) the printhead logic controls the power electronics as a function of the robot control data and as a function of the switching patterns.

23. An applicator according to claim 22, wherein the printhead logic comprises at least one of the following:

a) a communication interface for communication with the robot controller, b) a first logic unit for logically processing the switching patterns supplied by the graphics module, c) a synchronisation device for synchronising the switching patterns supplied by the graphics module with the robot controller, d) a second logic unit for compensating tolerances in the control chain to the actuators in order to achieve exact synchronization of the individual channels for the various actuators.

24. An applicator according to claim 17, wherein a) the actuators are electromagnetic actuators which each have a coil, b) with a first coil connection, the coil is permanently connected to ground or to a supply voltage irrespective of the switching state, c) with a second coil connection, the coil is connected via a controllable switching element to ground or to a supply voltage.

25. An applicator according to claim 24, wherein a free-wheeling diode is connected in parallel with the coil.

26. An applicator according to claim 17, wherein a) the actuators are electromagnetic actuators which each have a coil, b) with a first coil connection, the coil is connected via a first controllable switching element with a supply voltage, and c) with a second coil connection, the coil is connected to ground via a second controllable switching element.

27. An applicator according to claim 26, wherein a) with the second coil connection, the coil is connected to the supply voltage via a second free-wheeling diode or via a third controllable switching element, and b) with the first coil connection, the coil is connected to ground via a first freewheeling diode or a fourth controllable switching element.

28. An applicator according to claim 17, wherein the control circuit is integrated in the housing of the applicator.

29. An applicator according to claim 17, wherein the control circuit is integrated in the connecting flange of the applicator.

30. An applicator in accordance with claim 17, wherein the applicator is explosion-proof.

31. Coating robot with an applicator according to claim 17.

32. An applicator for applying a coating agent to a component, comprising:

a) several nozzles for the application of the coating agent in the form of a coating agent jet, b) a plurality of coating agent valves for controlling the release of the coating agent through the individual nozzles, and c) a plurality of electrically controllable actuators for controlling the coating agent valves, d) wherein a control circuit for electrically driving the actuators is integrated in the applicator, the integrated control circuit contains power electronics for driving the actuators and, e) wherein the power electronics drive the actuators with an electrical voltage which is in the range from 6V-96V.

33. An applicator according to claim 32, wherein the power electronics are connected to the actuators via short lines with a line length of at most 300 mm.

34. An applicator according to claim 32, wherein the power electronics actuate the individual actuators in such a way that an electric current flows through the individual actuators which is in the range from 0.01 A-10 A.

35. An applicator according to claim 32, wherein the power electronics drive the actuators with a pulse width modulation with a variable duty cycle or a frequency modulation or another modulation.

36. An applicator according to claim 32, wherein a) the integrated control circuit also comprises a printhead logic, b) the printhead logic is connected on the output side to the power electronics, c) the printhead logic is connected on the input side to at least one of a robot controller and a graphics module, d) the robot controller controls a coating robot which moves the applicator in a program-controlled manner over the component, the robot controller reporting robot control data to the printhead logic, e) the graphics module specifies switching patterns for the actuators in accordance with a predefined graphic and reports them to the printhead logic, and f) the printhead logic controls the power electronics as a function of the robot control data and as a function of the switching patterns.

37. An applicator according to claim 36, wherein the printhead logic comprises at least one of the following:

a) a communication interface for communication with the robot controller, b) a first logic unit for logically processing the switching patterns supplied by the graphics module, c) a synchronisation device for synchronising the switching patterns supplied by the graphics module with the robot controller, d) a second logic unit for compensating tolerances in the control chain to the actuators in order to achieve exact synchronization of the individual channels for the various actuators.

38. An applicator according to claim 32, wherein a) the actuators are electromagnetic actuators which each have a coil, b) the power electronics drive the coil of one of the actuators for opening the associated coating agent valve with a starting current, and c) the power electronics drive the coil of one of the actuators with a holding current in order to keep the associated coating agent valve, which has already been opened previously, open, the holding current being smaller than the starting current.

39. An applicator according to claim 32, wherein a) the actuators are electromagnetic actuators which each have a coil, b) with a first coil connection, the coil is permanently connected to ground or to a supply voltage irrespective of the switching state, c) with a second coil connection, the coil is connected via a controllable switching element to ground or to a supply voltage.

40. An applicator according to claim 10, wherein a free-wheeling diode is connected in parallel with the coil.

41. An applicator according to claim 32, wherein a) the actuators are electromagnetic actuators which each have a coil, b) with a first coil connection, the coil is connected via a first controllable switching element with a supply voltage, and c) with a second coil connection, the coil is connected to ground via a second controllable switching element.

42. An applicator according to claim 41, wherein a) with the second coil connection, the coil is connected to the supply voltage via a second free-wheeling diode or via a third controllable switching element, and b) with the first coil connection, the coil is connected to ground via a first freewheeling diode or a fourth controllable switching element.

43. An applicator according to claim 32, wherein the control circuit is integrated in the housing of the applicator.

44. An applicator according to claim 32, wherein the control circuit is integrated in the connecting flange of the applicator.

45. An applicator in accordance with claim 32, wherein the applicator is explosion-proof.

* * * * *